US010137342B2

(12) United States Patent
Hebreo et al.

(10) Patent No.: US 10,137,342 B2
(45) Date of Patent: Nov. 27, 2018

(54) GOLF CLUB HAVING REMOVEABLE WEIGHT

(71) Applicant: Acushnet Company, Fairhaven, MA (US)

(72) Inventors: Jonathan Hebreo, San Diego, CA (US); Andrew McCarthy, Carlsbad, CA (US); Noah de la Cruz, San Diego, CA (US); Grant M. Martens, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 9 days.

(21) Appl. No.: 15/393,746

(22) Filed: Dec. 29, 2016

(65) Prior Publication Data

US 2018/0117428 A1 May 3, 2018

Related U.S. Application Data

(63) Continuation-in-part of application No. 15/339,797, filed on Oct. 31, 2016.

(51) Int. Cl.

| | |
|---|---|
| ***A63B 53/06*** | (2015.01) |
| ***A63B 53/04*** | (2015.01) |
| ***A63B 60/52*** | (2015.01) |

(52) U.S. Cl.

CPC ..... *A63B 53/06* (2013.01); *A63B 53/0466* (2013.01); *A63B 60/52* (2015.10); *A63B 2053/0408* (2013.01); *A63B 2053/0433* (2013.01); *A63B 2053/0491* (2013.01); *A63B 2053/0495* (2013.01)

(58) Field of Classification Search

CPC .... A63B 2053/0491; A63B 2053/0433; A63B 2053/0495; A63B 53/06

USPC ..... 473/334–339, 341

See application file for complete search history.

(56) References Cited

U.S. PATENT DOCUMENTS

| | | | |
|---|---|---|---|
| 1,322,182 | A | 11/1919 | Duncan |
| 1,534,600 | A | 4/1925 | Mattern |
| 3,220,733 | A | 11/1965 | Saleeby |
| 4,150,464 | A | 4/1979 | Tracy |
| 4,869,507 | A | 9/1989 | Sahm |
| 5,230,509 | A | 7/1993 | Chavez |

(Continued)

OTHER PUBLICATIONS

U.S. Appl. No. 14/977,116, filed Dec. 21, 2015, Luttrell et al.
U.S. Appl. No. 15/257,692, filed Sep. 6, 2016, Cleghorn et al.
U.S. Appl. No. 15/282,854, filed Sep. 30, 2016, Frame et al.

*Primary Examiner* — Benjamin Layno
(74) *Attorney, Agent, or Firm* — Michael J. Mancuso

(57) ABSTRACT

A golf club head includes a club head body and a weight member that is secured to the body in a weight mount. The weight member is constructed to utilize lateral forces to couple to the head body to minimize the structure required to retain the weight member. The weight member includes a spring feature that is movably coupled to a weight body so that it is movable between a first configuration and a second configuration. In the second configuration a portion of the spring feature extends outward from a side wall of the weight body. The weight mount includes an undercut and the spring feature extends into the undercut and is partially flexed by the abutment of the spring feature and a perimeter wall of weight mount when the weight member is disposed in the weight mount.

16 Claims, 18 Drawing Sheets

(56) References Cited

U.S. PATENT DOCUMENTS

| | | | | |
|---|---|---|---|---|
| 5,316,305 | A | 5/1994 | McCabe | |
| 5,720,674 | A | 2/1998 | Galy | |
| 5,794,316 | A | 8/1998 | Anscher | |
| 5,935,019 | A | 8/1999 | Yamamoto | |
| 6,123,627 | A | 9/2000 | Antonious | |
| 6,458,044 | B1 | 10/2002 | Vincent et al. | |
| 6,902,432 | B2 | 6/2005 | Morikawa et al. | |
| 7,166,041 | B2 | 1/2007 | Evans | |
| 7,186,190 | B1 | 3/2007 | Evans | |
| 7,604,548 | B2 | 10/2009 | Cole | |
| 7,628,711 | B2 | 12/2009 | Akinori et al. | |
| 7,758,452 | B2 | 7/2010 | Soracco | |
| 7,775,905 | B2 | 8/2010 | Beach et al. | |
| 8,192,303 | B2 | 6/2012 | Ban | |
| 9,387,376 | B1 | 7/2016 | Hall et al. | |
| 9,387,377 | B2 | 7/2016 | Liang et al. | |
| 9,744,415 | B2 * | 8/2017 | Frame | A63B 53/06 |
| 2006/0122004 | A1 | 6/2006 | Chen et al. | |
| 2008/0132353 | A1 | 6/2008 | Hsiao | |
| 2009/0143167 | A1 | 6/2009 | Evans | |
| 2009/0221380 | A1 * | 9/2009 | Breier | A63B 53/0466 473/288 |
| 2010/0323815 | A1 * | 12/2010 | Bezilla | A63B 53/04 473/335 |
| 2015/0321055 | A1 * | 11/2015 | Golden | A63B 53/0466 473/338 |
| 2016/0166894 | A1 * | 6/2016 | Curtis | A63B 53/06 473/324 |

* cited by examiner

GOLF CLUB HAVING REMOVEABLE WEIGHT

CROSS-REFERENCE TO RELATED APPLICATIONS

This application is a continuation-in-part of U.S. patent application Ser. No. 15/339,797, filed Oct. 31, 2016, currently pending, the disclosure of which is hereby incorporated by reference in its entirety.

FIELD OF THE INVENTION

The invention relates to golf clubs, and more particularly, to golf club heads having a removable weight.

BACKGROUND OF THE INVENTION

The trend of lengthening golf courses to increase their difficulty has resulted in a high percentage of amateur golfers constantly searching for ways to achieve more distance from their golf shots. The golf industry has responded by providing golf clubs specifically designed with distance and accuracy in mind. The size of wood-type golf club heads has generally been increased while multi-material construction and reduced wall thicknesses have been included to provide more mass available for selective placement through the head. The discretionary mass placement has allowed the club to possess a higher moment of inertia (MOI), which translates to a greater ability to resist twisting during off-center ball impacts and less of a distance penalty for those off-center ball impacts.

Various methods are used to selectively locate mass throughout golf club heads, including thickening portions of the body casting itself or strategically adding a separate weight element during the manufacture of the club head. An example, shown in U.S. Pat. No. 7,186,190, discloses a golf club head comprising a number of moveable weights attached to the body of the club head. The club head includes a number of threaded ports into which the moveable weights are screwed. Though the mass characteristics of the golf club may be manipulated by rearranging the moveable weights, the cylindrical shape of the weights and the receiving features within the golf club body necessarily moves a significant portion of the mass toward the center of the club head, which may not maximize the peripheral weight of the club head or the MOI.

Alternative approaches for selectively locating mass in a club head utilize the incorporation of composite structures of multiple materials. These composite structures often utilize two, three, or more materials, including various metallic and non-metallic materials that have different physical properties including different densities. An example of this type of multi-material head is shown in U.S. Pat. No. 5,720,674. The club head comprises an arcuate portion of high-density material bonded to a recess in the back-skirt. Because the different materials included in the club head must be coupled, for example by welding, swaging, or using bonding agents such as epoxy, they may be subject to delamination or corrosion over time. This component delamination or corrosion results in decreased performance in the golf club head and can lead to club head failure.

Though many methods of optimizing the mass properties of golf club heads exist, there remains a need in the art for a golf club head comprising at least a removable weight having secure attachment and a low-profile so that the weight does not protrude into the center of the club head and negatively affect the location of the center of gravity.

SUMMARY OF THE INVENTION

The present invention is directed to a golf club head having at least one weight mount and at least one movable or removable weight member.

In an embodiment, a golf club head includes a club head body, a weight mount, and a weight member. The club head body includes a hollow construction defined by a face defining a ball-striking surface, a sole, a crown, and a skirt. The sole extends aftward from a lower edge of the face, the crown extends aftward from an upper edge of the face, and the skirt extends between the sole and the crown around a perimeter of the body. The weight mount disposed on at least one of the sole, the crown, and the skirt, wherein the weight mount defines a perimeter wall and a portion of the perimeter wall defines an undercut having an undercut depth $R_u$. The weight member includes a weight body defining a side wall and a spring feature. At least a portion of the spring feature is movably coupled to the weight body so that it is movable between a first configuration and a second configuration. In the first configuration a portion of the spring feature extends outward from a side wall of the weight body by a first distance $R_1$, and in the second configuration a portion of the spring feature extends outward from a side wall of the weight body by a second distance $R_2$. The undercut depth $R_u$ is less than the first distance $R_1$ and greater than the second distance $R_2$ so that the spring feature abuts the undercut of the perimeter wall of the weight mount, and the spring feature is at least partially flexed by the abutment of the spring feature with the perimeter wall when the weight member is installed in the weight mount.

In another embodiment, a golf club head includes a club head body, a weight mount, and a weight member. The club head body has a hollow construction defined by a face defining a ball-striking surface, a sole, a crown, and a skirt. The sole extends aftward from a lower edge of the face, the crown extends aftward from an upper edge of the face, and the skirt extends between the sole and the crown around a perimeter of the body. The weight mount is disposed on at least one of the sole, the crown, and the skirt. The weight mount defines a perimeter wall, and a portion of the perimeter wall defines an undercut having an undercut depth $R_u$. The weight member includes a weight body defining a side wall and a spring feature. At least a portion of the spring feature is movably coupled to the weight body so that it is movable between a first configuration and a second configuration. In the first configuration a portion of the spring feature extends outward from a side wall of the weight body by a first distance $R_1$, and in the second configuration a portion of the spring feature extends outward from a side wall of the weight body by a second distance $R_2$. The undercut depth $R_u$ is less than the first distance $R_1$ and greater than the second distance $R_2$ so that the spring feature abuts the undercut of the perimeter wall of the weight mount. The spring feature is a cantilevered arm that includes a fixed end and a cantilevered end, and the fixed end is coupled to the weight body. The weight body includes a diametric bore that receives a portion of the cantilevered arm and the weight body includes a slot that intersects the diametric bore so that at least a portion of the cantilevered arm is exposed when the weight member is installed in a weight mount. The spring feature is at least partially flexed by the abutment of the spring feature with the perimeter wall when the weight member is installed in the weight mount.

In another embodiment, a golf club head includes a club head body, a weight mount, and a weight member. The club head body has a hollow construction defined by a face defining a ball-striking surface, a sole, a crown, and a skirt. The sole extends aftward from a lower edge of the face, and the crown extends aftward from an upper edge of the face. The skirt extends between the sole and the crown around a perimeter of the body. The weight mount is disposed on at least one of the sole, the crown, and the skirt. The weight mount defines a perimeter wall, and a portion of the perimeter wall defines an undercut having an undercut depth $R_u$. The weight member includes a weight body defining a side wall and a spring feature, and at least a portion of the spring feature is movably coupled to the weight body so that it is movable between a first configuration and a second configuration. In the first configuration a portion of the spring feature extends outward from a side wall of the weight body by a first distance $R_1$, and in the second configuration a portion of the spring feature extends outward from a side wall of the weight body by a second distance $R_2$. The undercut depth $R_u$ is less than the first distance $R_1$ and greater than the second distance $R_2$ so that the spring feature abuts the undercut of the perimeter wall of the weight mount when the weight member is installed in the weight mount. The spring feature is a slide member that slides in the weight body between the first configuration and the second configuration. The weight body includes a radial slot and side walls of the radial slot include grooves, and the slide member is disposed in the slot and portions of the slide member extend into the grooves. In the second configuration an outer edge of the slide member is closer to flush with the weight body than the first configuration. The spring feature is at least partially flexed by the abutment of the spring feature with the perimeter wall when the weight member is installed in the weight mount.

DETAILED DESCRIPTION

Figure 1:
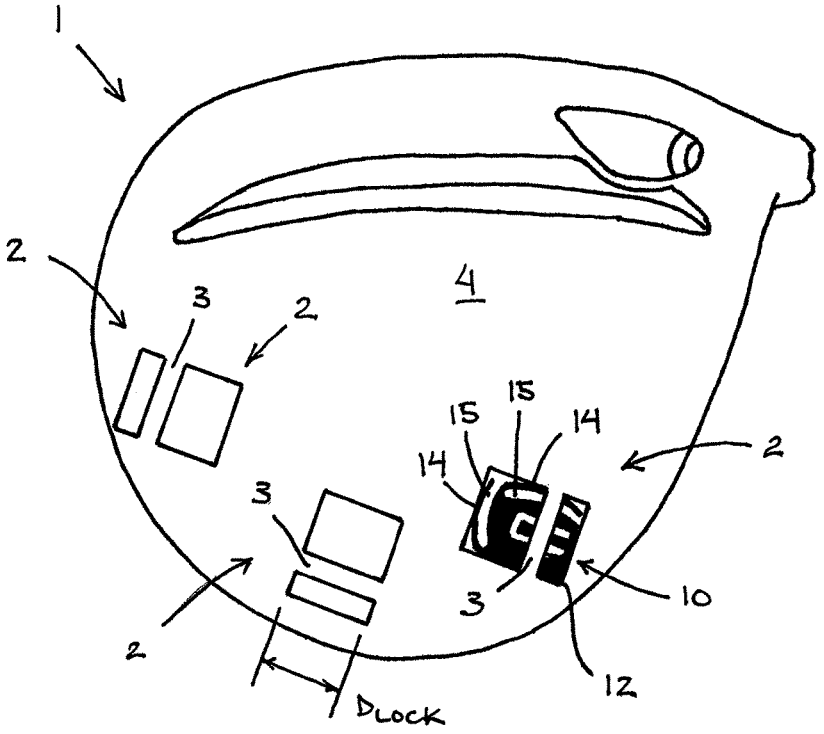
FIG. 1 is a bottom view of a golf club head including a weight member in accordance with the present invention.
Figure 3:
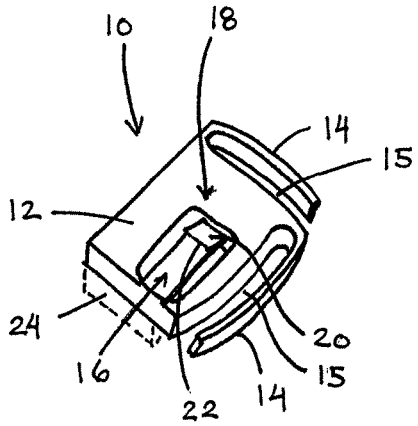
FIG. 3 is a perspective view of the weight member included in the golf club head of FIG. 1.
Figure 2:
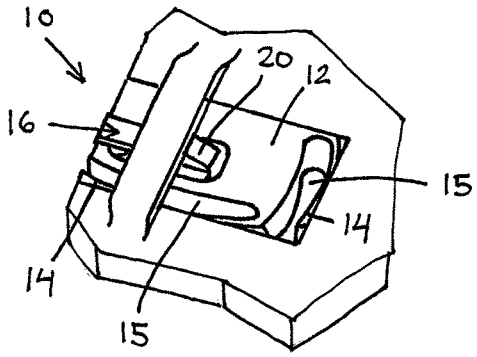
FIG. 2 is a perspective view of a portion of a golf club head of FIG. 1.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Many weight structures utilize attachment mechanisms that primarily utilize a force in the direction of an axis that is orthogonal to the outer contour of golf club head for attaching weight member to the golf club head. According to the present invention, weight members that primarily utilize forces that are generally directed parallel or tangential to the outer contour of the golf club head and lateral to the weight member are described. Utilizing attachment configurations that primarily interact with the surrounding structure of the golf club head in parallel or tangentially to the outer contour of the golf club head reduces the amount of structure that extends toward the interior of the golf club head that would otherwise be required to retain the weight member.

In an aspect of the present invention, an embodiment of a weight member 10, having a low profile, includes a simple clip-in type attachment that does not require the use of a threaded fastener to couple the weight member 10 to the golf club head 1. Golf club head 1 has a hollow bodied construction that includes a face, a sole 4, a crown, a skirt, and a hosel that combine to define the hollow interior. As is well known in the art, the body may be formed by numerous methods and those methods may be used alone or in combination, and the club head body may include cast, stamped and/or forged components that are combined together. In an example, the head body may include a cast component including the sole, crown, skirt and hosel and a stamped face component that is welded to the cast component. In another example, the head body may include forged sole, crown, hosel, and face components that are welded together.

The face defines a ball-striking surface. The sole 4 extends aftward from a lower edge of the face. The crown extends from an upper edge of the face and the skirt extends between the sole 4 and crown and around the perimeter of the body. Golf club head 1 also includes a plurality of weight attachment structures, such as weight mounts 2. Weight member 10 includes a body 12, and three spring features. The spring features include two side wall spring features that are flexible arms 14 and a locking spring feature formed by a flexible locking arm 16 on another surface. Each flexible arm 14 is defined by an elongate aperture 15 that extends through the thickness of body 12 and that intersects the side wall of body 12.

The side wall spring features and locking arm 16 combine to prevent relative movement between the weight cartridge and the golf club head in three orthogonal axes, e.g., the X, Y and Z axes, so that the weight member is fully constrained from translation when the weight member is installed in a weight mount. In particular, the dimensions of the weight mount 2 are selected so that the portions abutting the flexible arms are narrower than the free width of the weight member at the flexible arms. As a result of those dimensions, the flexible arms 14 and locking arm 16 are at least partially flexed laterally and act upon the surrounding structure of the weight mount 2 and are compressed to exert lateral force on the surrounding structure to prevent translation of the weight member 10 in every direction, i.e., in three orthogonal axes.

The weight member 10 also includes a locking mechanism that selectively locks the weight member 10 into the golf club head 1 at one of the weight mount 2. The locking arm 16 may include a locking tooth 18 that prevents the weight member 10 from becoming dislodged and disengaging from the golf club head 1 during impact. In the illustrated embodiment, the locking arm 16 interacts with a locking feature on the weight mount 2, such as a bridge member 3 that forms an undercut portion in weight mount 2. Bridge member 3 extends across a portion of the weight member 10 when the weight member 10 is inserted into a weight mount 2. Locking tooth 18 includes a tapered surface 20 that abuts and slides past bridge member 3 when the weight member 10 is inserted into a weight mount 2. That contact forces locking arm 16 to flex so that the locking tooth 18 slips past bridge member 3, which allows the weight member 10 to be fully inserted into the weight mount 2. Bridge member 3 may also include a tapered abutment surface that gradually increases contact force between tooth 18 and bridge member 3. The weight member 10 and weight mount 2 are dimensioned so that when the weight member 10 is fully inserted, the tapered surface 20 of locking tooth 18 passes the contacting portion of bridge member 3 and a ledge 22 of locking tooth 18 engages a portion of bridge member 3. The engagement of the ledge 22 and bridge member 3 prevents the weight member 10 from disengaging the weight mount 2, but the weight member 10 may be removed by displacing locking tooth 18 relative to bridge member 3 so that the locking tooth 18 is able to slip past bridge member 3 to allow weight member 10 to be retracted from weight mount 2. It should be appreciated that the height of flexible arms 14 may differ from the overall thickness of the weight member 10. For example, an extension portion, shown by dashed portion 24, may be included to increase the volume of weight member 10. Additionally, ledge 22 may be replaced with a second tapered surface that allows the weight member 10 to be removed without separately flexing locking arm 16 to disengage the locking tooth 18 from bridge member 3. The taper of the second tapered surface is preferably steeper than tapered surface 20.

Figure 4:
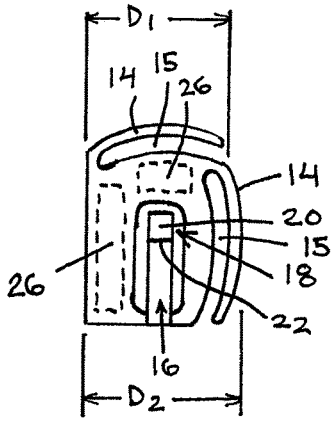
FIG. 4 is a front view of the weight member that may be included in the golf club head of FIG. 1.
Figure 5:
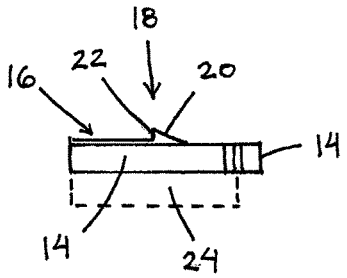
FIG. 5 is a side view of the weight member of FIG. 4.
Figure 6:
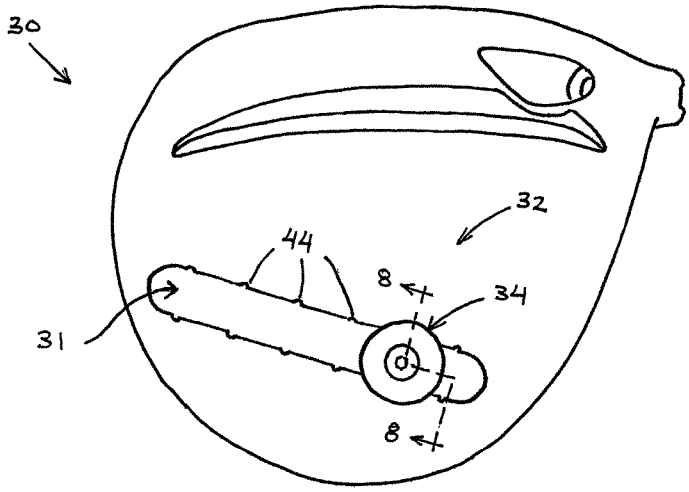
FIG. 6 is a bottom view of a golf club including another weight member in accordance with the present invention.
Figure 7:
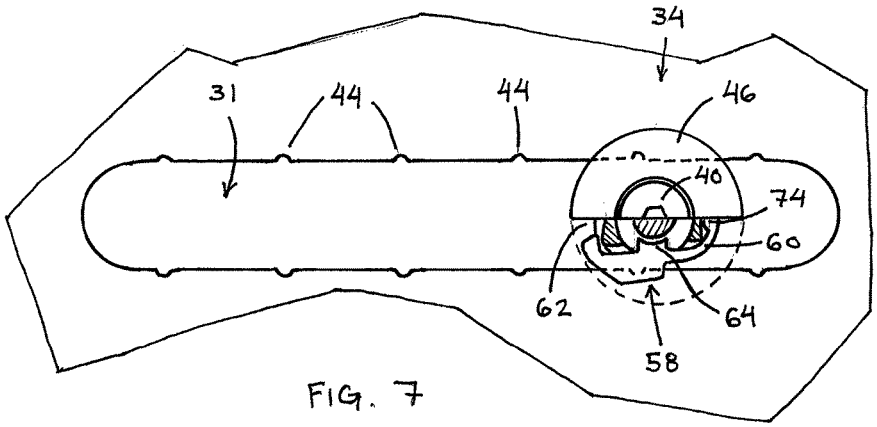
FIG. 7 is a bottom view of a portion of the golf club head of FIG. 6.
Figure 8:
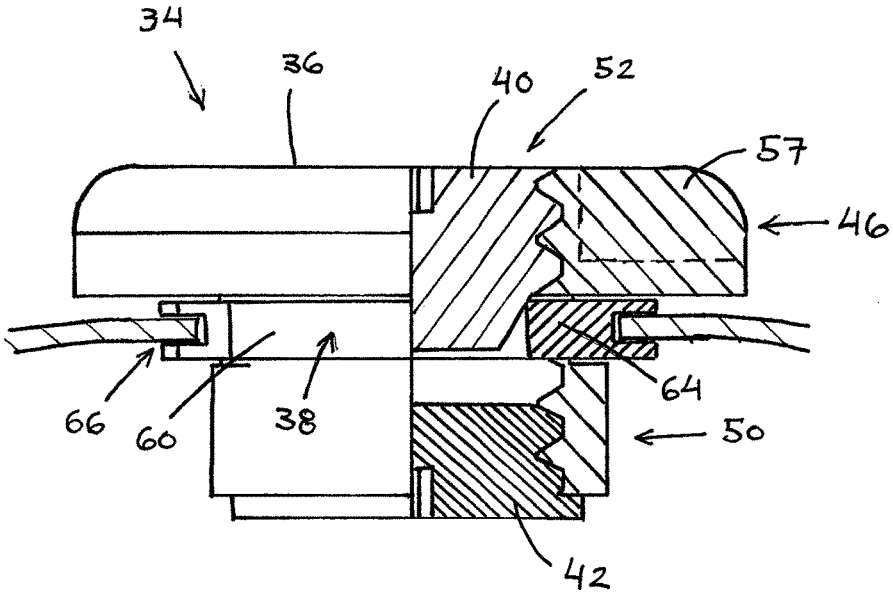
FIG. 8 is a partial cross-section of the golf club head of FIG. 6, as shown by line 8-8.
Figure 9:
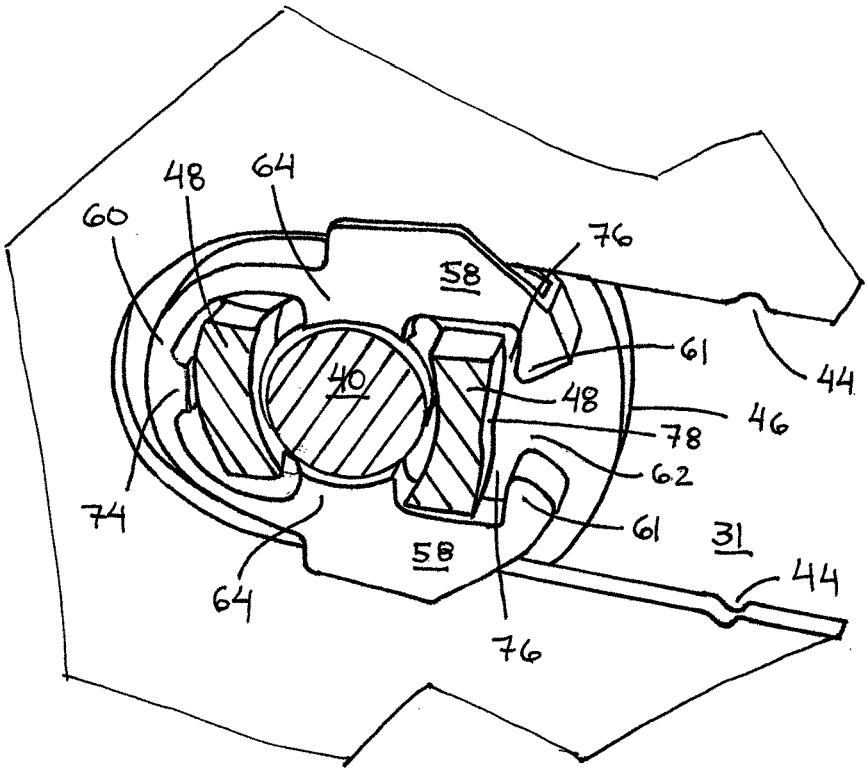
FIG. 9 is a perspective view showing a partial cross-section of a portion of the golf club head of FIG. 6.
Figure 10:
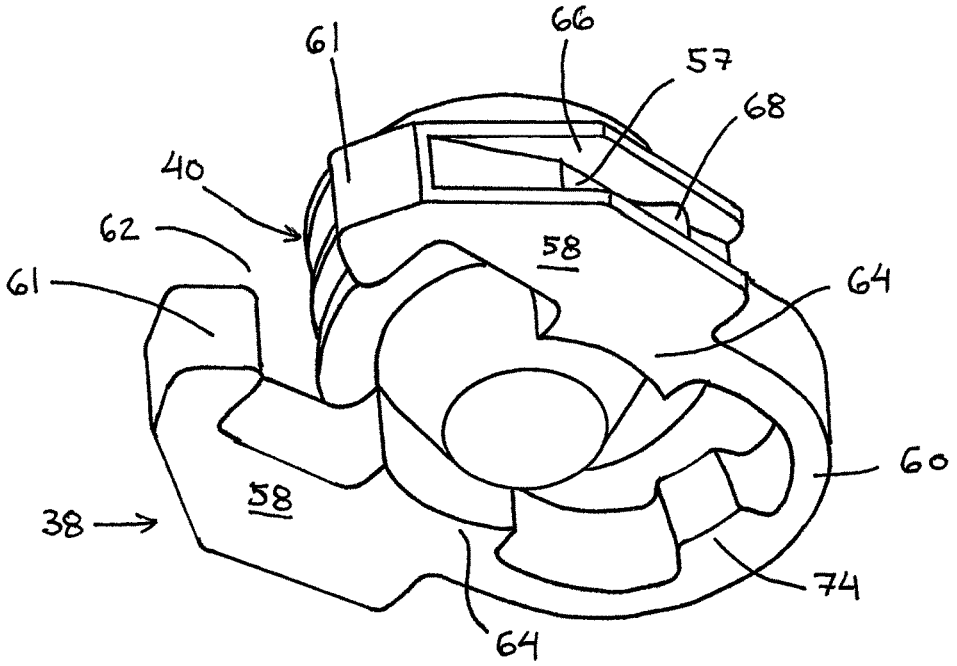
FIG. 10 is a perspective view of a portion of the weight member included in the golf club head of FIG. 6.
Figure 11:
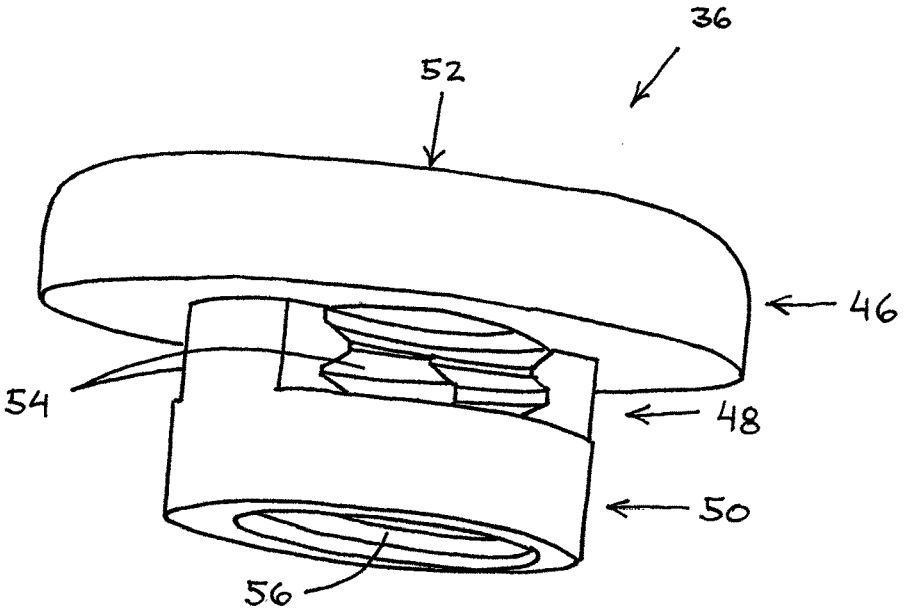
FIG. 11 is a perspective view of a portion of the weight member included in the golf club head of FIG. 6.
Figure 12:
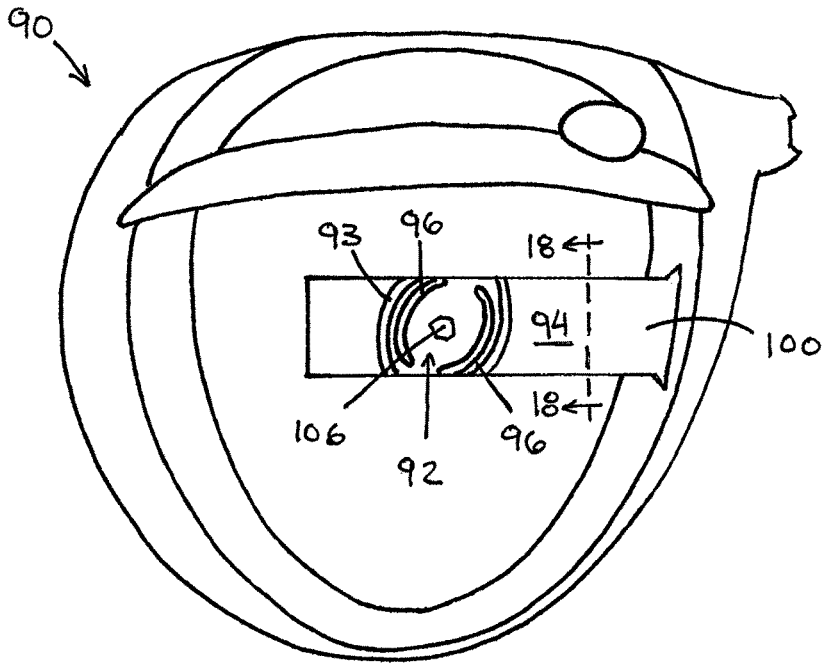
FIG. 12 is a bottom view of a golf club including another weight in accordance with the present invention.
Figure 13:
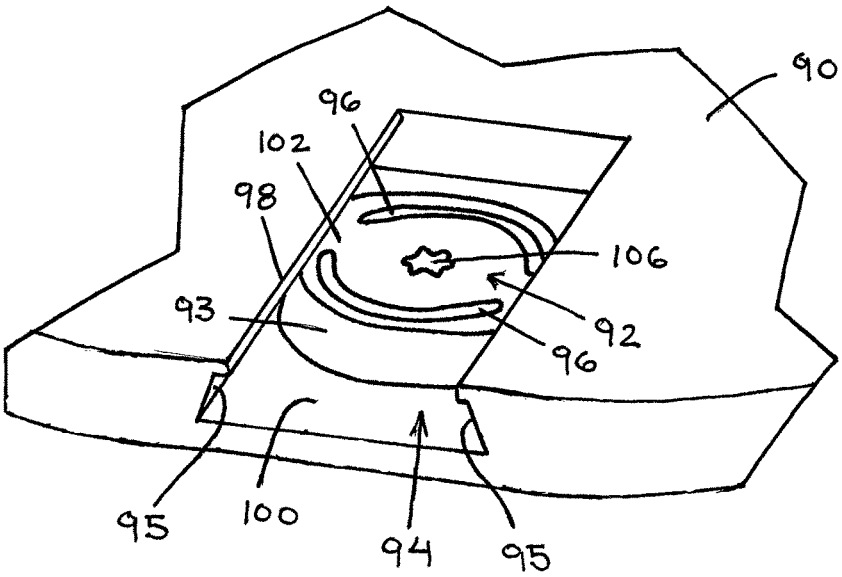
FIG. 13 is a perspective view of a portion of the golf club head of FIG. 12.
Figure 14:
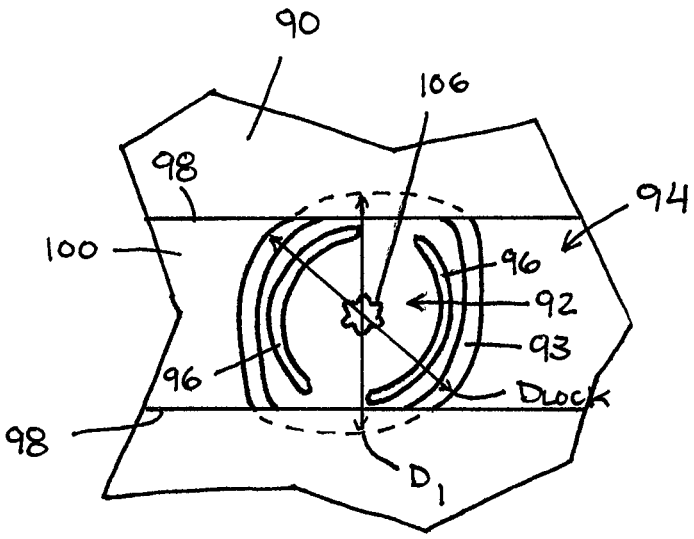
FIG. 14 is a bottom view of a portion of the golf club head of FIG. 12, illustrating a weight member in an unlocked orientation.
Figure 15:
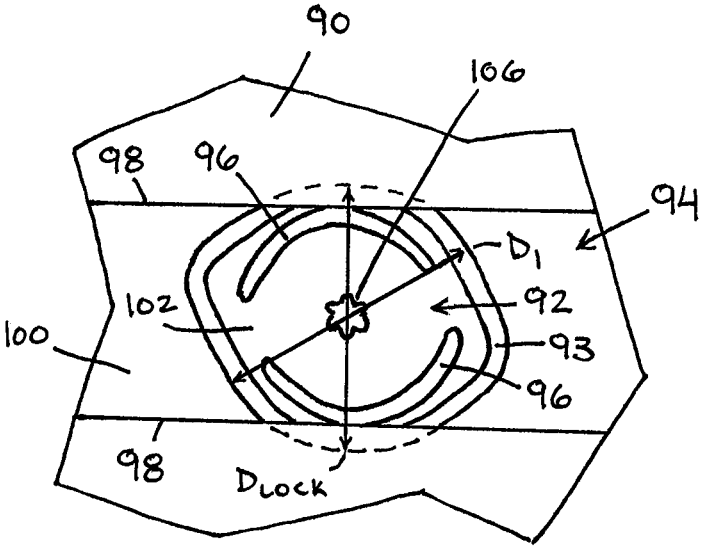
FIG. 15 is a bottom view of a portion of the golf club head of FIG. 12, illustrating a weight member in a locked orientation.
Figure 16:
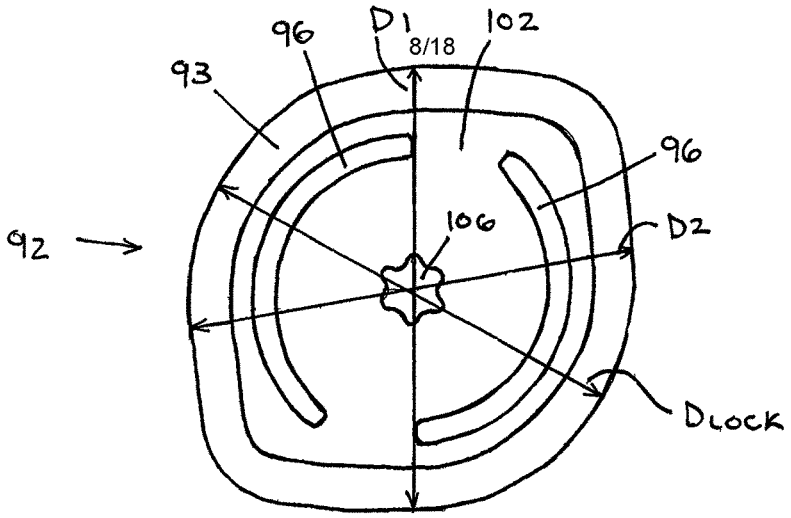
FIG. 16 is a bottom view of the weight member included in the golf club head of FIG. 12.
Figure 17:
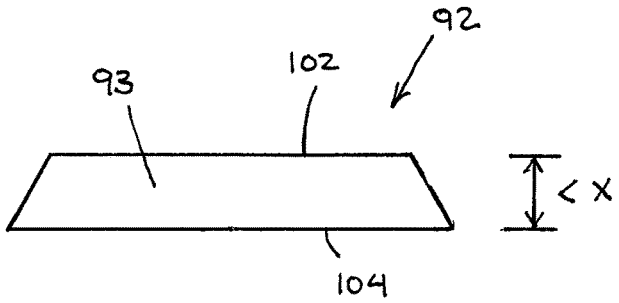
FIG. 17 is a side view of the weight member included in the golf club head of FIG. 12.
Figure 18:
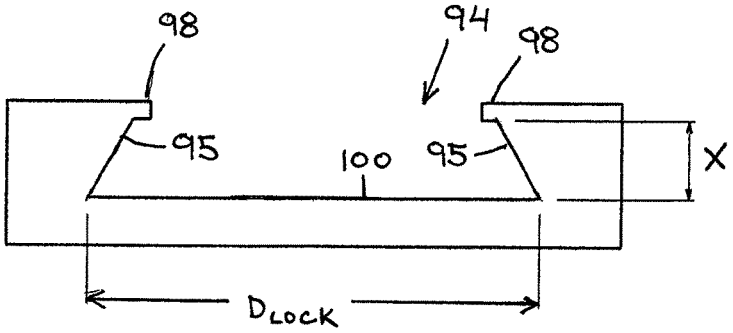
FIG. 18 is a cross-sectional view of the weight track of FIG. 12, taken along line 18-18.

Weight member 10 may be constructed from a single material or it may have a multi-material construction. For example, as shown in FIG. 4, portions of the weight body 12, shown by dashed portions 26, may include recesses or may be constructed of a material having a different specific gravity than the remainder of the weight body to create an insert that is heavier or lighter relative to the weight body. In embodiments having a heavy or light insert, the insert may be joined with the weight body by many different methods, including mechanically fixing the insert to the weight body by threaded engagement, and/or fasteners. Alternatively, the materials may be coupled using metallurgical joining techniques, such as welding, swaging, forging the materials together, or co-casting.

Referring to FIGS. 6-11, a golf club head 30 includes another weight system 32 that provides adjustability of the center of gravity of the golf club head and that is disposed on a body member. The weight system 32 includes weight member 34 and a weight mount in the form of slot 31 extending through at least a portion of the thickness of the body member. Weight member 34 is assembled from a weight body 36, a spring clip 38, a locking member 40, and an optional weight slug 42. Weight member 34 is installed in slot 31, slides along edges of slot 31, and is configured to naturally seat in detent recesses 44 that are included in the edges of slot 31. Preferably, weight member 34 provides an audible and/or tactile "click" when it seats in each of the detent recesses 44 included in slot 31.

Weight body 36 provides the primary source for mass in weight member 34, while providing a frame for supporting spring clip 38. In particular, the weight body 36 includes an outer portion 46 that resides outside of slot 31 when weight member 34 is installed, a clip portion 48 that receives spring clip 38 and resides in slot 31 when weight member 34 is installed, and an inner portion 50 that is sized to extend through slot 31. In the illustrated embodiment, outer portion 46 is a generally cylindrical portion of the weight body 36. Preferably, the outer portion has an outer dimension that prevents it from being inserted into slot 31, so that it limits the insertion of the weight body 36 into slot 31. It should be appreciated that the outer portion 46 need not be cylindrical, and the shape and size of the outer portion 46 may be altered to alter the overall mass of the weight body 36 and weight member 34. Outer portion 46 also includes a locking member mount 52, such as a bore that receives locking member 40 and that extends into clip portion 48. For example, locking member mount 52 may be a threaded bore that threads with a locking member 40 that includes a threaded portion. As a further alternative, outer portion 46 may have a multi-material construction so that the mass of weight body 36 may be altered, such as by replacing a portion of the outer portion 46 indicated by dashed area 57 with a component constructed of a material having a different specific gravity than the material of weight body 36.

The clip portion 48 and inner portion 50 extend from outer portion 46. Clip portion 48 is interposed between outer portion 46 and inner portion 50 of weight body 36 and provides a mounting structure for spring clip 38 on weight body 36. In particular, clip portion 48 includes slots 54 on opposite sides of the weight body 36. Spring clip 38 is disposed on weight body in clip portion 48 so that a portion spring clip 38 resides in slots 54. The configuration of slots 54 results in outer portion 46 and inner portion 50 creating shoulders that straddle spring clip 38 and retain it in the direction of a longitudinal axis of weight body 36. Slots 54 extend through the side wall of the clip portion 48 so that a portion of the spring clip 38 intersects the bore that forms the locking member mount 52 when spring clip 38 is installed on weight body 36.

Inner portion 50 extends away from outer portion 46 and clip portion 48 and is sized so that it may extend through slot 31. In the illustrated embodiment, inner portion 50 is generally an annular cylindrical body that has an outer diameter that is smaller than the width of the opening of slot 31. It should be appreciated that inner portion 50 may include parts that have an outer dimension that is greater than the opening of slot 31, as long as some part of inner portion 50 has an outer dimension that allows it to be inserted into a portion of slot 31. It should also be appreciated that inner portion 50 need not be cylindrical, but may alternatively have a polygonal shape, such as a square or rectangle, or another curved shape. Inner portion 50 may also include a mounting feature for weight slug 42, which may be used to increase the mass of weight member 34. For example, inner portion 50 may include a mount 56 that allows a selected weight slug 42 to be coupled to weight body 36. Mount 56 may be a threaded bore and weight slug 42 may be a threaded weight member that is selected from a plurality of weight slugs 42 having different masses and threaded into mount 56.

Spring clip 38 generally includes two arms 58 that are able to flex toward and away from each other. The arms 58 are coupled by a flexure 60 and terminate at terminal ends 61 that are spaced from each other to define a gap 62. Spring clip 38 also includes locking tabs 64 that extend inward from arms 58. Locking tabs 64 extend through the side wall of clip portion 48 so that they intersect a portion of the bore that forms locking member mount 52.

Each of arms 58 defines an outer channel 66, that is at least partially defined by an outer engagement surface 67, and that receives a portion of the side wall of slot 31. A detent projection 68 is disposed in each outer channel 66 that is shaped and sized to complement the shape and size of the detent recesses 44 included in slot 31. The detent projection 68 is a portion of outer engagement surface 67 that locally extends outward. Spring clip 38 and slot 31 are shaped so that spring clip 38 is biased outward when it is installed in slot 31. As a result, spring clip 38 remains in contact with the edges of slot 31 and creates the force that causes the detent projections 68 to click into the detent recesses 44.

The sizes of the channels 66 and detent projections 68 are selected so that there is minimal clearance between those features and the complementary portions of the slot 31. That minimal clearance allows the weight member 34 to move along slot 31 while preventing additional movement relative to the walls of slot 31. As a further alternative, the edges of slot 31, including detent recesses 44 may be beveled, and the detent projections 68 may be tapered so that when the projections engage the recesses, the weight member 34 is drawn further into slot 31 and against the wall of golf club head 30. Spring clip 38 is constructed so that arms 58 may be spread apart from one another so that clip portion 48 of weight body 36 may be inserted through gap 62 and locking tabs 64 located in slots 54.

Locking member 40 is included to selectively provide support to spring clip 38 to limit inward motion of the locking tabs 64 when the weight member 34 is positioned at a detent location. Locking member 40 is a tapered screw that includes a threaded portion 70 and a tapered tip portion 72. Threaded portion 70 couples with the threaded bore included in outer portion 46 of weight body 36 and allows a user to advance and retract locking member 40 relative to weight body 36. The tapered tip portion 72 extends into clip portion 48 of weight body 36 and is configured to selectively abut an inner surface of locking tabs 64, thereby preventing arms 58 of spring clip 38 from flexing inward toward each other when the weight member 34 is located at a detent. Locking member 40 may also be used to increase the force between the spring clip 38 and the walls of slot 31 by advancing the locking member 40 further into weight body 36 after contact is established between locking tabs 64 and the tapered tip portion 72. Preferably, the locking member 40 is dimensioned so that it requires between ¼ and ½ of a turn of the locking member to disengage the spring clip 38 enough to allow the weight member 34 to slide along slot 31.

In general, the weight member 34 is slid in slot 31 by a user grasping outer portion 46 of weight body 36 and sliding the weight member 34. However, because spring clip 38 is configured to slide against the walls of slot 31 the spring clip 38 may shift in clip portion 48 relative to weight body 36. That shift may cause the spring clip 38 to interact with the side walls of clip portion 48 and locking member 40 which can cause the arms 58 of spring clip 38 to be pushed outward, or spring clip 38 to twist relative to slot 31, thereby increasing the friction between the spring clip 38 and the slot wall and further hindering the ability to slide the weight member in slot 31. Accordingly, features that prevent the relative motion between the spring clip 38 and the other components, and/or features that prevent the arms 58 of spring clip 38 from spreading due to the relative motion are included in the construction of weight member 34. For example, spring clip 38 may include a spacer 74 that is incorporated into flexure 60 that limits both the space between spring clip 38 and clip portion 48 of weight body 36 and the relative motion between the two components. Additionally, spring clip 38 may be shaped to limit a gap 76 between clip portion 48 and the terminal ends 61 of arms 58, and the surface of clip portion 48 closest to terminal ends 61 may include a concavity 78 so that contact between concavity 78 and terminal ends 61 draws arms 58 together. Still further, the width of locking tabs 64 may be selected to closely clear the width of the portions of slots 54 that receive tabs 64 so that the amount of clearance between the locking tabs 64 and slots 54 dictates the range of motion of the spring clip 38 relative to the weight body 36.

In general, slot 31 is only required to be an elongate opening in a wall of the golf club head that includes detent features to interact with weight member 34. It is generally desirable to close the slot so that the interior of the golf club head is not exposed, so a slot cover may be installed to close the interior volume of the golf club head. The cover may be a thin-walled trough or tray that may be glued inside the golf club head to cover the slot and to seal the inner cavity of the golf club head from air, water or other debris.

In another embodiment, shown in FIGS. 12-18, a golf club head 90 includes a weight member 92 that utilizes spring features and a cam shape to lock the weight member 92 into a desired location in a weight mount that is formed by a shallow track 94. The weight member 92 may be rotated in the track 94 between a first, unlocked orientation, shown in FIG. 14, in which a side wall 93 of the weight member 92 is spaced from the side wall of the track 94, and a second, locked orientation, shown in FIG. 15. When the weight member 92 is in the locked orientation, the cam shape results in the side wall 93 of the weight member 92 abutting the side wall 95 of the track 94 and creating an outward, lateral force between track 94 and weight member 92.

Weight member 92 is generally a monolithic weight body that is shaped so that it functions as a cam in track 94, and includes an outer surface 102, an inner surface 104, and side wall 93 extends between outer surface 102 and inner surface 104. In particular, the side wall 93 of weight member 92 is curved and non-circular so that the outer dimension varies with the angular orientation of the weight member 92. In an example, weight member 92 has an oculiform shape, i.e., is shaped like an eye, so that the overall outer dimension taken through a centroid of the weight member varies between a minimum overall outer dimension $D_1$ of 28.5 mm and a maximum overall outer dimension $D_2$ of 30.0 mm. The side wall 93 of the weight member 92 is beveled at an angle in a range of 20° to 40°, and more preferably at an angle of about 30° and the weight member 92 has a thickness of about 4.8 mm. Weight member 92 also includes slots 96 that are generally semi-circular elongate apertures spaced from the side wall 93 so that the side wall 93 forms a spring feature. Preferably, the slot has a width of between about 1.5 mm and about 3.0 mm, and is spaced from the side wall 93 by a distance of about 1.5 mm at outer surface 102 of weight member 92.

Track 94 is generally formed by angled, or beveled, side walls 95 that form undercuts on the sides of the weight mount. The side walls 95 of the track 94, which are preferably parallel to the side wall 93 of weight member 92, are beveled at an angle about equal to the angle of the side wall of the weight member, in particular at an angle of about 30° relative to a bottom wall support surface 104 of track 94. The contact between the beveled side walls during rotation of the weight member 92 relative to track 94 causes weight member 92 to be drawn into the track 94 so that inner surface 104 is forced against support surface 100 of track. The outermost edges of track 94 include ledges 98 that form overhanging shoulders that are spaced from support surface 100 of track 94 by a distance that is greater than the thickness of weight member 92 to provide a gap so that weight member 92 may slide in track 94. Preferably, the distance is greater than the thickness of weight member 92 by about 0.01 inch to about 0.05 inch. The width of the track is selected to allow both locking and sliding of the weight member 92. In particular, the width of the track 94 at each elevation above the support surface 100 is selected to be between a minimum and a maximum outer dimension of the weight member at each corresponding elevation from support surface 100. Additionally, support surface 100 has a value $D_{Lock}$ that is between the minimum overall outer dimension $D_1$ and the maximum overall outer dimension $D_2$ of inner surface 104 of weight member 92 so that the weight member may be locked in place by rotation and cam action.

A tool engagement feature 106 is included in the body of weight member 92 for locking weight member 92 in track. In particular, tool engagement feature 106 is a feature that receives a portion of a tool, such as a screw driver or torque wrench, so that the tool may be used to rotate weight member 92 in track 94.

Figure 19:
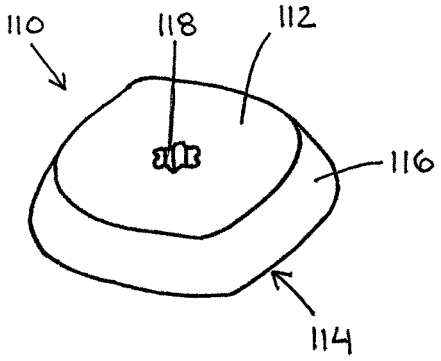
FIG. 19 is a perspective view of an alternative embodiment of the weight of FIG. 17.

Alternative embodiments of a weight member utilizing a cam shape to lock the weight member in place in a shallow track are illustrated in FIGS. 19-22, all of which may have a generally oculiform in shape. Referring to FIG. 19, a weight member 110 is similar to the weight member of FIGS. 12-17, but does not include the spring features formed by slots. Weight member 110 generally includes an outer surface 112, an inner surface 114, a side wall 116, and a tool engagement feature 118. Weight member 110 is shaped to cam against walls of a weight track having beveled side walls, such as weight track 94. The side wall 116 of weight member 110 is beveled to match the side walls of a complementary track and the weight member 110 locks in the track in the same manner as weight member 92 described above.

Figure 20:
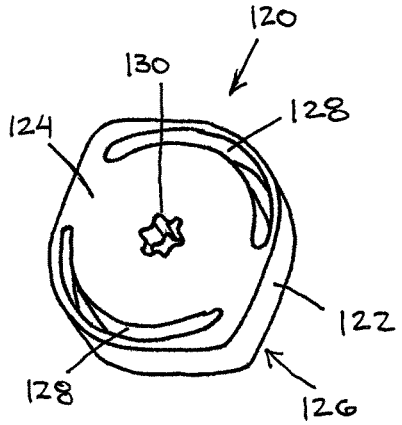
FIG. 20 is a perspective view of another alternative embodiment of the weight of FIG. 17.
Figure 21:
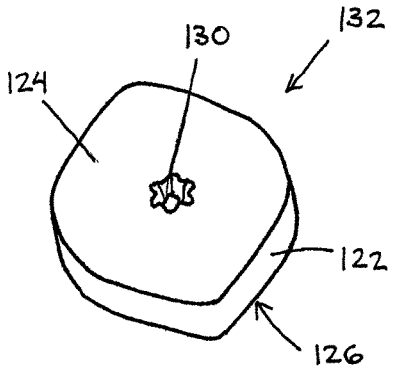
FIG. 21 is a perspective view of another alternative embodiment of the weight of FIG. 17.

Referring to FIG. 20, a weight member 120 including a square side wall 122 will be described. Weight member 120 includes side wall 122 that extends between an outer surface 124 and an inner surface 126 and is generally square in relation to those surfaces, i.e., generally extends from those surfaces at a 90° angle. The side wall of the weight member may be square or beveled. Generally, a square side wall provides only lateral locking force, while a beveled side wall provides both vertical and lateral forces to restrict motion of the weight member relative to the track. As a result, the depth of the track may be selected to prevent relative motion of the weight member relative to the track in a direction orthogonal to the cam force especially for weights having square side walls.

Weight member 120 also includes optional spring features to further lock the weight member into place in the locked position of the cam motion. In particular, slots 128 extend through the body of weight member 120 between outer surface 124 and inner surface 126 near side wall 122. The proximity of slots 128 to side wall 122 results in a portion of the side wall 122 functioning as a spring. Similar to previous embodiments, weight member 120 includes a tool engagement feature 130. As described above, the spring features may be used to increase the cam force between the weight member and the track if needed. However, in some embodiments, that additional spring force is not required, and a weight member 132, shown in FIG. 21, has a construction identical to weight member 120 without the slots forming the spring features, and because of the otherwise identical construction it will not be described further in detail.

Figure 22:
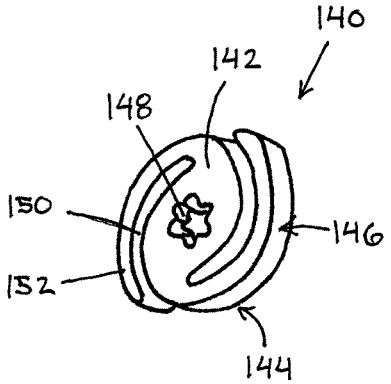
FIG. 22 is a perspective view of another alternative embodiment of the weight of FIG. 17.
Figure 23:
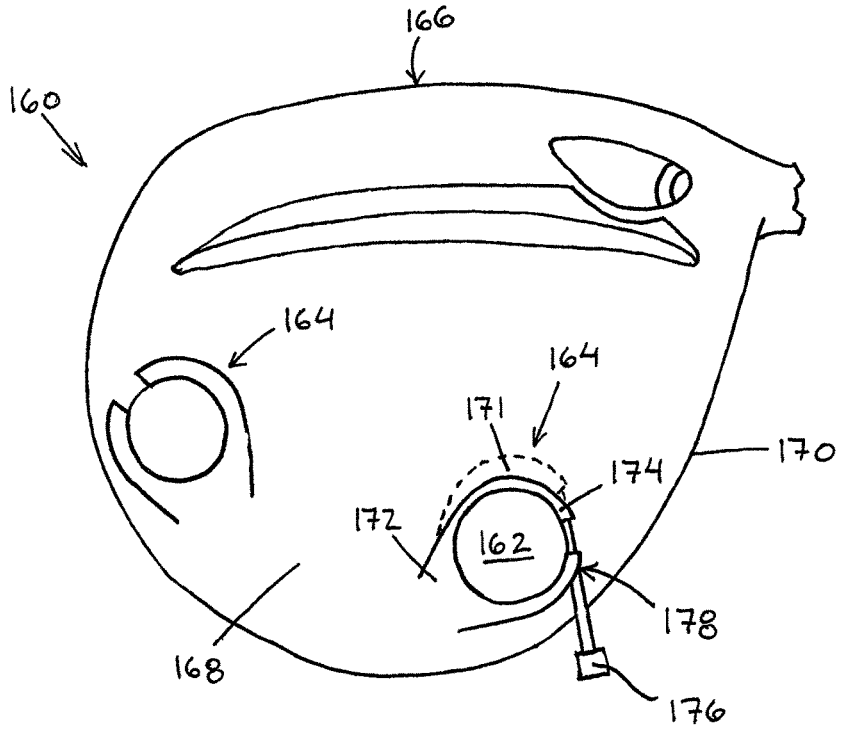
FIG. 23 is a bottom view of a golf club head including another weight member in accordance with the present invention.
Figure 24:
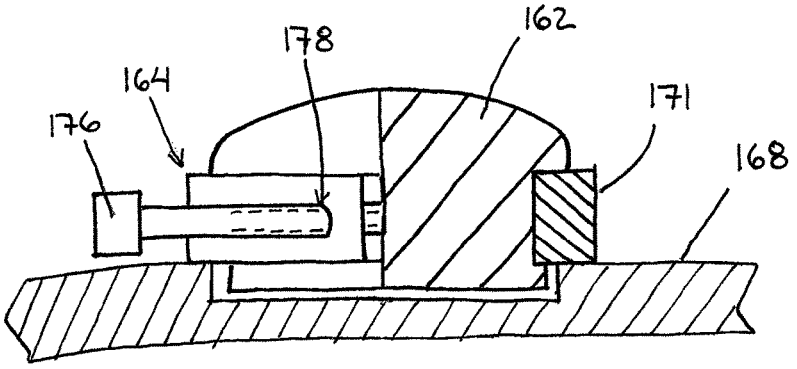
FIG. 24 is a partial cross-section view of the weight mount and weight member shown in FIG. 23.

In another embodiment, a weight member 140 includes an alternative construction for spring features and is illustrated in FIG. 22. Weight member 140 includes an outer surface 142, an inner surface 144, a side wall 146 and a tool engagement feature 148. The construction of weight member 140 is similar to the construction of weight member 120 with an alternative spring feature. In particular, weight member 140 includes slots 150 that intersect side wall 146, so that side wall 146 is discontinuous and so that portions of the body of weight member 140 form cantilevered arms 152 that are configured to flex and to provide spring features. All other aspects of the construction of weight member 140 are similar to those described above and will not be further described.

In another embodiment, a golf club head 160 includes a weight member 162 that is captured by a spring clamp 164 that forms a locking portion of a weight mount. Golf club head 160 generally is a hollow body defined by a face 166, a sole 168, a crown, and a skirt 170 that extends between the crown and sole 168, and is preferably manufactured by standard methods. The golf club head 160 includes at least one mount that accepts and retains the weight member 162, and preferably includes a plurality of weight mounts.

The spring clamp 164 is configured to be in a naturally clamped configuration, which may be described as an "always-on" configuration. By activating the spring clamp 164 with a tool, the clamp opens and releases the captured weight member 162. A portion of the spring clamp 164 is fixed to a portion of the golf club head 160 and another portion of the spring clamp 164 forms a free end. The spring clamp 164 is preferably integrated into the construction of the golf club head 160, such as by casting the spring clamp 164 into the construction of the body. Alternatively, the spring clamp 164 may be constructed as a separate component and fixed on a portion of the golf club head body, such as by welding or mechanical fasteners.

The spring clamp 164 is affixed at the opening of a mount built into the golf club head 160 to form the locking portion of the weight mount. Spring clamp 164 is generally formed by at least one flexible arm 171 that includes a fixed end 172 and a free end 174. In the illustrated embodiment, the fixed end 172 is fixedly coupled to a portion of sole 168 and at least one free end 174 extends cantilevered from fixed end 172. Spring clamp 164 is configured as a C-clamp with a spring integrated into the construction of the flexible arm 171 to keep the clamp "on," or closed shut, but it should be appreciated that a separate spring may be incorporated into the spring clamp, such as by incorporating a torsion spring.

A tool 176 is used to open the clamp to permit weight member 162 to be installed in, or removed from, the mount. In the illustrated embodiment, tool 176 is threaded into a threaded bore 178 included at a portion of spring clamp 164 near free end 174 of flexible arm 171. An end of tool 176 extends out of threaded bore 178 and abuts free end 174 so that threading tool 176 further into the threaded bore 178 forces the flexible arm to flex outward to open the spring clamp. Unthreading and removing tool 176 from the threaded bore 178 allows the flexible arm 171 to return to its natural position, thereby returning the spring clamp to the natural clamped configuration. Although a threaded tool is illustrated, the tool may be used to open the clamp by different mechanisms. For example, the tool may be configured to act as a lever, push-action, pinch, cam, etc. Additionally, it should be appreciated that more than one arm of the spring clamp may be constructed to be flexible during use. For example, both arms of the illustrated spring clamp 164 may flex when tool 176 is threaded into the threaded bore 178.

Figure 25:
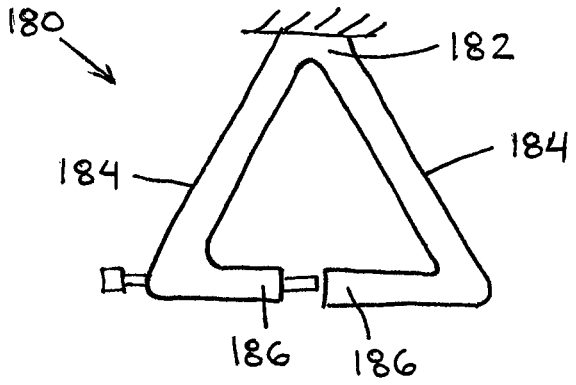
FIG. 25 is a bottom view of an alternative embodiment of the weight mount of FIG. 23.
Figure 26:
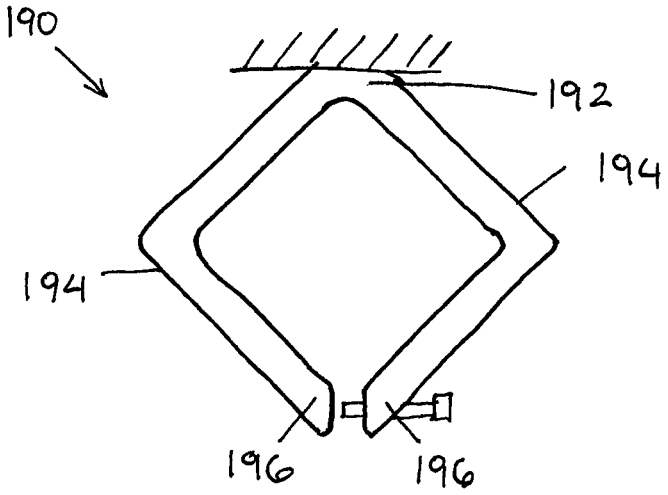
FIG. 26 is a bottom view of an alternative embodiment of the weight mount of FIG. 23.
Figure 27:
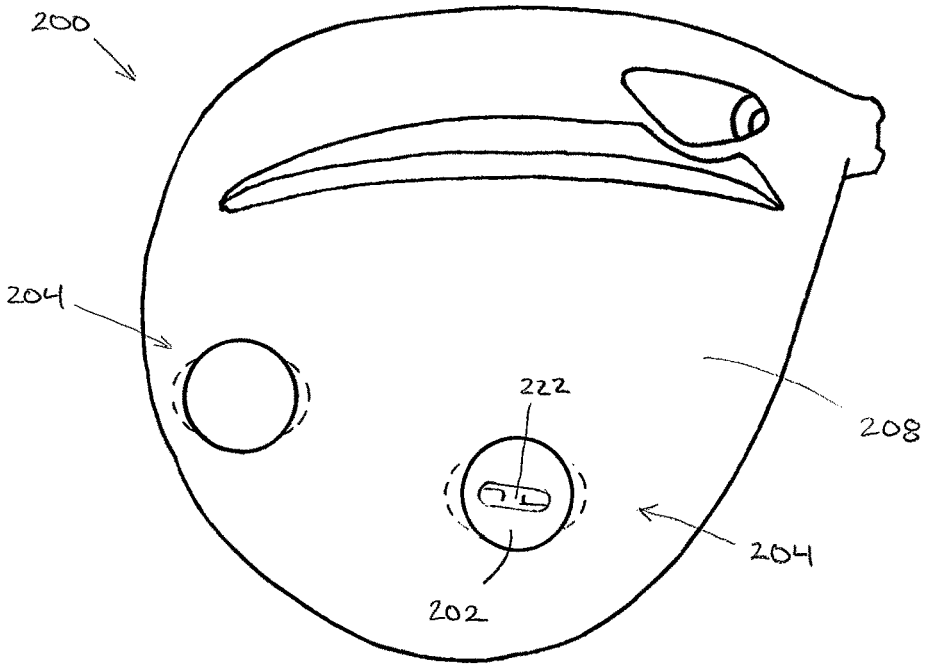
FIG. 27 is a bottom view of a golf club head including another weight member in accordance with the present invention.
Figure 28:
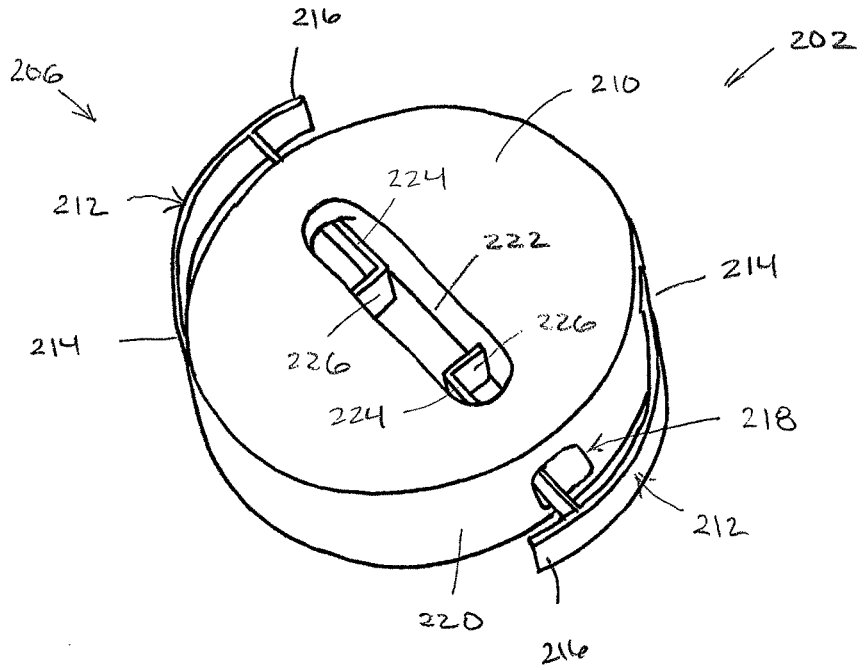
FIG. 28 is a perspective view of the weight member illustrated in FIG. 27
Figure 29:
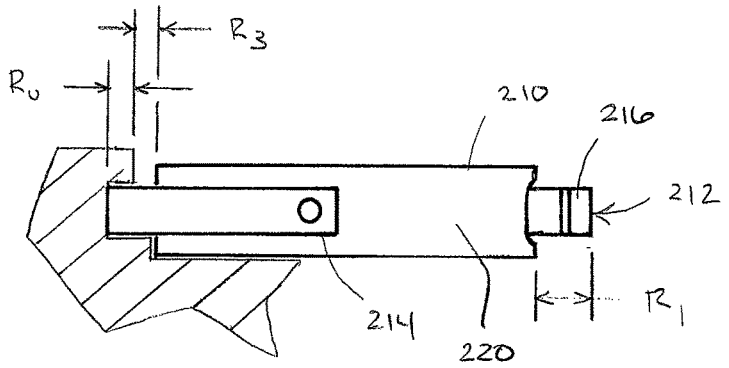
FIG. 29 is a partial cross-section view of a portion of the golf club head of FIG. 27.
Figure 30:
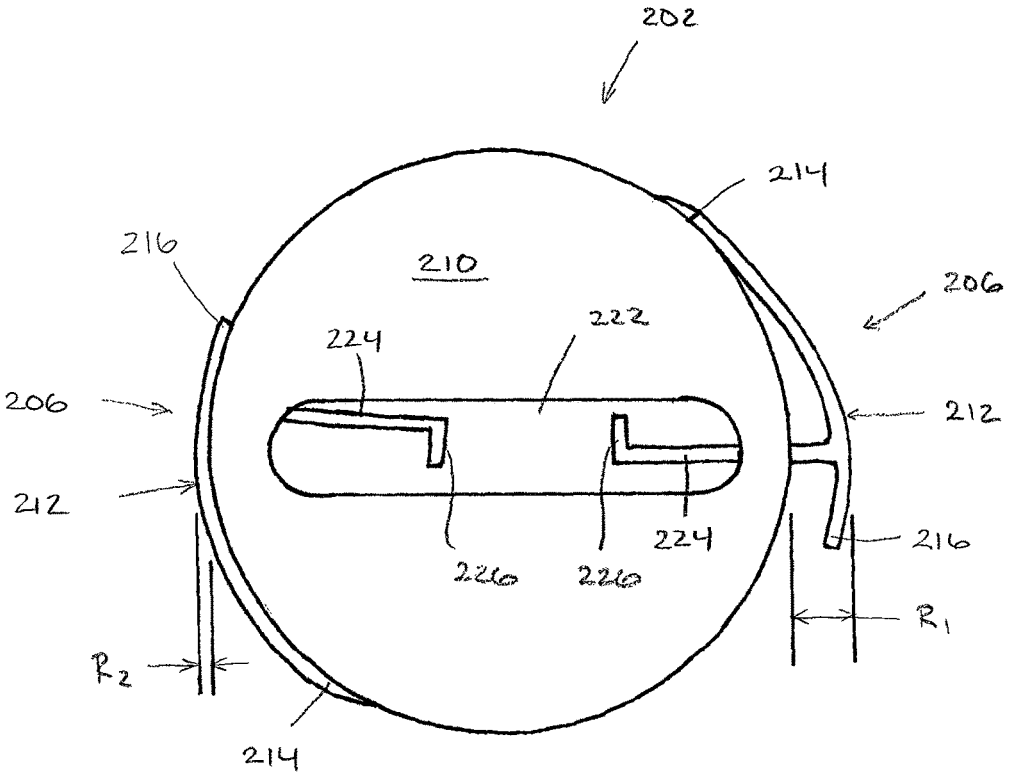
FIG. 30 is a top view of the weight member of FIG. 27.

Referring to FIGS. 25 and 26, the spring clamp may have many alternative shapes that provide different advantages. For example, a spring clamp may have a polygonal shape to complement a polygonal weight member and that shape prevents rotation of the weight member in the spring clamp. Referring first to FIG. 25, a spring clamp 180 includes a fixed portion 182 and flexible arms 184 that terminate at free ends 186. Spring clamp 180 has a generally triangular shape that receives a triangular weight member. In another embodiment, shown in FIG. 26, a spring clamp 190 includes a fixed portion 192, and flexible arms 194 that terminate at free ends 196. Spring clamp 190 has a generally rhomboid shape that receives a complementary weight member. It should be appreciated that the spring clamp may have many alternative shapes to complement the shape of an accompanying weight member.

Another embodiment of a weight is illustrated in FIGS. 27-30. Similar to previous embodiments, a weight may be constructed with at least one spring feature that is movable between a first configuration and a second configuration to allow the weight to be inserted and removed from a weight mount in a golf club head. Golf club head 200 includes a weight member 202 that is disposed in a weight mount 204 and held in place by lateral force applied to the weight mount 204 by spring features 206. Similar to previous embodiments, golf club head 200 has a hollow bodied construction that includes a face, a sole 208, a crown, a skirt, and a hosel that combine to define the hollow interior. The golf club head body may be constructed as described above with respect to the other embodiments, such as by forging and/or casting. Weight mount 204 generally has an outer opening that is exposed externally to the golf club head and that allows a user to insert a weight member 202 into the weight mount 204.

Weight member 202 includes a body 210, and a plurality of spring features 206, in the form of flexible arms 212. The spring features are constructed so that at least a portion of each spring feature is movable between a first configuration in which a portion of the spring feature extends away from a side wall of body 210 by a first dimension $R_1$, and a second configuration in which a portion of the spring feature is movable to a position in which it extends away from a side wall of body 210 by a second dimension $R_2$ that is less than first dimension $R_1$. The weight mount 204 is constructed so that it includes an opening that is sized to allow weight member 202 to pass through the opening when the spring features 206 are in the second configuration. Preferably, the opening in the weight mount is sized so that there is a gap between an outer dimension of the body 210 and the opening that has a gap dimension $R_3$ that is larger than second dimension $R_2$, and more preferably larger than second dimension $R_2$ by less than 20%. It should, however be appreciated that embodiments of the weight member may be constructed that allow spring feature to be recessed into the side wall of the body of the weight member so that the gap dimension is not required to be greater than the second dimension $R_2$. After the weight member 202 is inserted into weight mount 204, through the opening, the spring features move toward the first configuration into undercuts of the weight mount 204. Each undercut has a depth $R_u$ from the outer dimension of body 210 that is less than the first dimension $R_1$ of the first configuration of the spring features so that when the spring feature extends into the undercut it places a lateral force upon the sidewall of the weight mount 204 and retains weight member 202 in the weight mount.

In the present embodiment, the body 210 is generally cylindrical so that it forms a disc. Body 210 includes a through hole 218 that extends generally diametrically through body 210, and through a side wall 220 formed on body 210. As illustrated, the through hole 218 may be positioned at a mid-point of the thickness of body 210, but it should be understood that it may be closer to an outer end or closer to an inner end of body 210 to adjust the depth of the center of gravity of the weight member 202 relative to the weight mount 204. A slot 222 is included in body 210 that extends partially through the thickness of body 210 and intersects through hole 218.

Each flexible arm 212 includes a first end 214 that is fixed to body 210, and a second end 216 that is spaced from first end 214 by a flexible body. The first ends 214 are preferably fixed to body 210 mechanically with fasteners, metallurgically such as by welding or brazing, or by using adhesive such as epoxy. Preferably, each of the flexible arms 212 is coupled to the body 210 at a location that is spaced approximately 45° from the opening of through hole 218, and the flexible arms are preferably positioned so that they are spaced approximately 180° from each other. The flexible body is constructed so that it is bendable, which allows second end 216 to move radially relative to body 210.

Each flexible arm 212 also includes a radial arm 224 that extends radially inward, and into through hole 218, from a location on flexible arm 212 that is at or adjacent first end 214. In the present embodiment, each of the flexible arms 212 has a radial arm 224 attached near the second end 216 so that the flexible arm 212 extends past the radial arm 224 and beyond the opening of the through hole 218. The length of each radial arm 224 is selected so that a portion of each radial arm 224 intersects slot 222 so that the radial arm may be manipulated by a user. The end of each radial arm 224 furthest from flexible arm 212 may also be shaped to include a tool engagement feature 226, such as by including a bent portion, that is bent at approximately 90°, that may be grasped by a tool.

In the illustrated embodiment, the tool engagement features 226 of radial arms 224 may be grasped and squeezed together by translating the bent portions towards each other to activate the spring features 206 and bend flexible arms 212 radially inward, and preferably in line, i.e., approximately flush, with the perimeter of the weight member 202. After the flexible arms 212 are bent inward, the weight member 202 may be inserted into weight mount 204. After insertion, the tool engagement features 226 may be released so that flexible arms 212 spring outward and abut against sidewalls of weight mount 204, thereby locking the weight member 202 into the weight mount 202. Similarly, by squeezing the tool engagement features 226 toward each other, the weight member 202 may be released and removed from weight mount 204. As described above, the spring features 206 have a default configuration in which the flexible arms extend away from body 210 so that if the weight member 202 is located in a weight mount 204, the spring features push against the side walls of the weight mount 204.

The spring features are constructed so that at least a portion of each spring feature is movable between a first configuration in which a portion of the spring feature extends away from a side wall of body 210 by a first dimension $R_1$, and a second configuration in which a portion of the spring feature is movable to a position in which it extends away from a side wall of body 210 by a second dimension $R_2$ that is less than first dimension $R_1$. The weight mount 204 is constructed so that it includes an opening that is sized to allow weight member 202 to pass through the opening when the spring features 206 are in the second configuration. Preferably, the opening in the weight mount is sized so that there is a gap between an outer dimension of the body 210 and the opening that has a gap dimension $R_3$ that is larger than second dimension $R_2$, and more preferably larger than second dimension $R_2$ by less than 20%. In an embodiment, the first distance $R_1$ is between about 1.0 mm and about 4.0 mm and greater than the undercut depth, and the second distance $R_2$ is less than 1.0 mm. It should, however be appreciated that embodiments of the weight member may be constructed that allow spring feature to be recessed into the side wall of the body of the weight member so that the opening in the weight mount need only provide clearance for the size of the body. After the weight member 202 is inserted into weight mount 204, through the opening, the spring features move toward the first configuration into undercuts of the weight mount 204. Each undercut has a depth $R_u$ from the outer dimension of body 210 that is less than the first dimension $R_1$ of the first configuration of the spring features so that when the spring feature extends into the undercut it places a lateral force upon the sidewall of the weight mount 204 and retains weight member 202 in the weight mount.

The body may be constructed from any material, but is preferably constructed from a metallic material, which is selected to provide the weight member with a preselected overall mass. The body and weight mount are shaped to complement each other, and any shape may be selected. Additionally, portions of the weight member may be coated, such as with a polymer material, so that there is a soft material disposed between the weight member and the weight mount.

Figure 37:
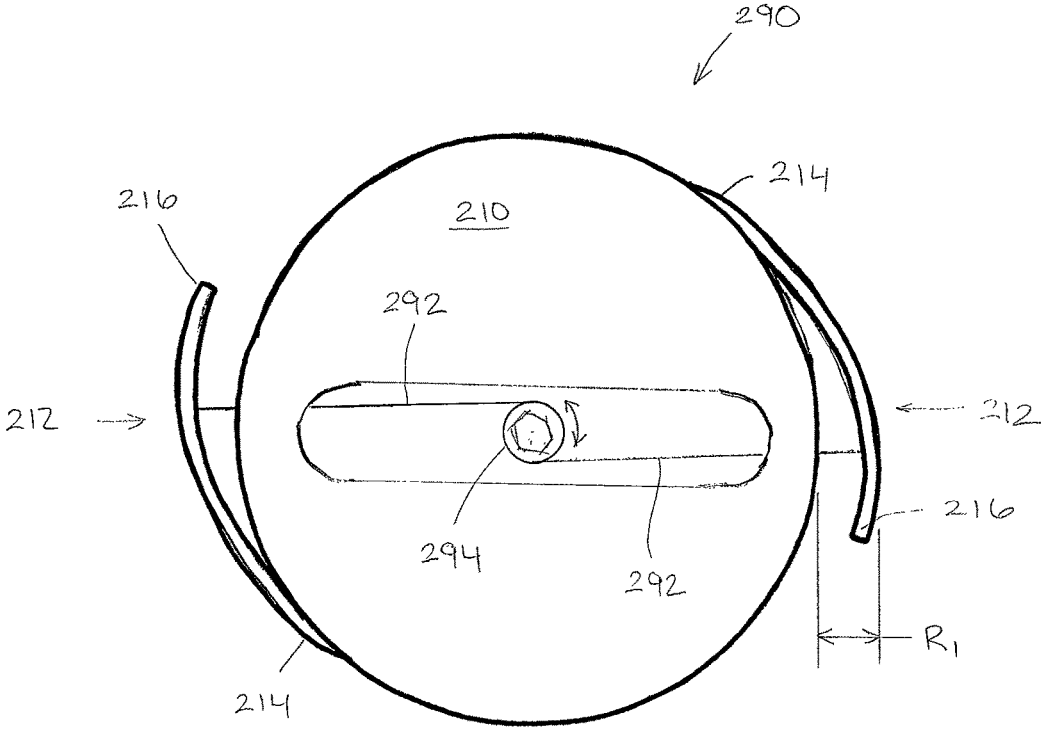
FIG. 37 is a top view of an alternative construction of the weight member of FIG. 27.

Referring to FIG. 37, an alternative construction of weight member 202 is provided in which the radially arms are replaced by an actuator that utilizes tension members to move the spring features between the first configuration and the second configuration. As illustrated, a weight member 290 is constructed similar to weight member 202 and has similar components which are assigned identical part numbers and will not be described in further detail. In the present embodiment, a tension member 292 extends from each of the flexible arms 212 to an actuator 294. Actuator 294 is a component that is rotatably coupled to body 210. The tension members 292 are preferably flexible members such as wire or cable that coils around actuator 294 when actuator 294 is rotated in a first direction and uncoils from actuator 294 when it is rotated in a second direction. Additionally, the flexibility and spring behavior of the arms may be utilized to uncoil the tension members from actuator by releasing the actuator. It should be appreciated that the actuator 294 may be cylindrical or it may be shaped as a cam, such as by shaping it as a nautilus, to alter the amount of rotation required to retract the flexible arms.

Figure 31:
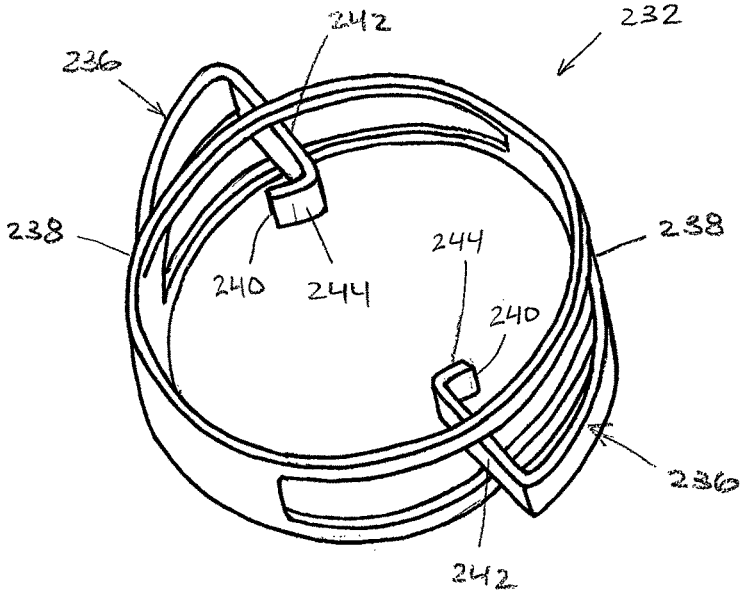
FIG. 31 is an alternative construction of the spring features for a weight member.
Figure 32:
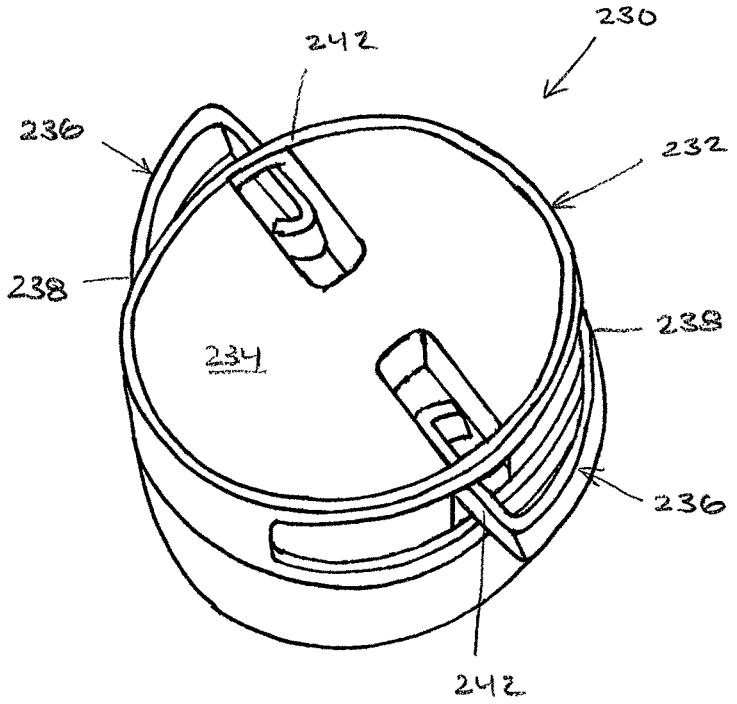
FIG. 32 is a weight construction including the spring features of FIG. 31.
Figure 33:
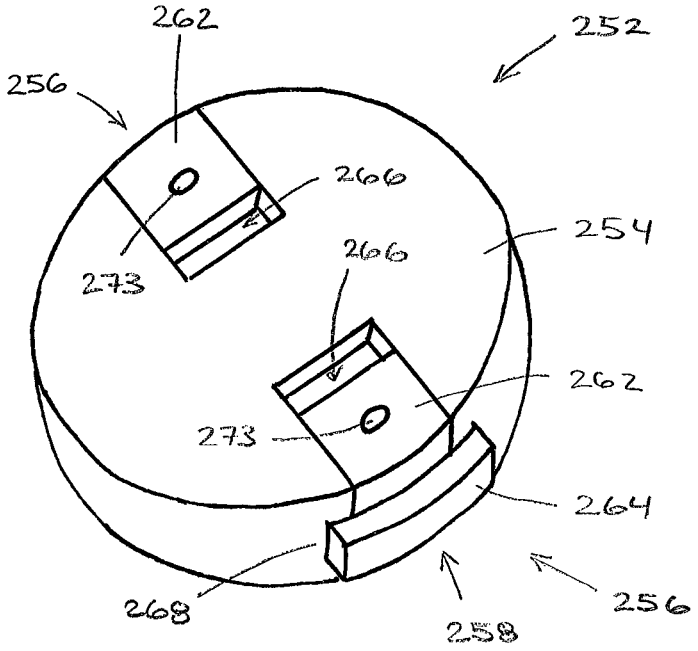
FIG. 33 is a perspective view of another weight member in accordance with the present invention.
Figure 34:
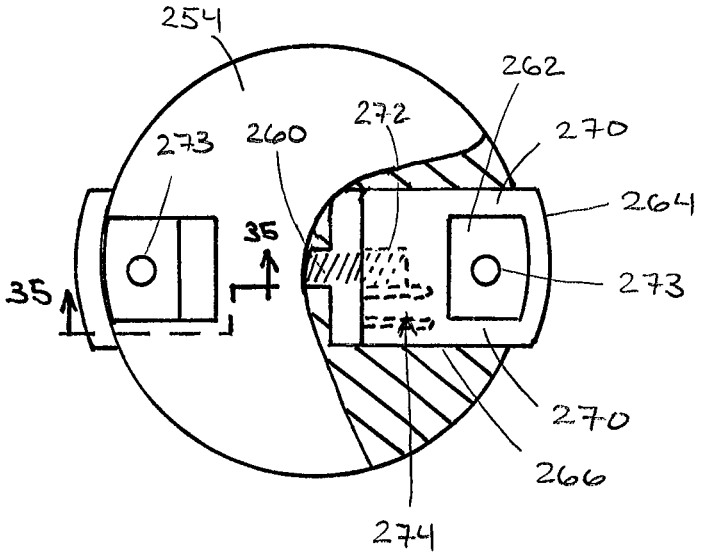
FIG. 34 is a partial cross-section view of the weight member of FIG. 33.
Figure 35:
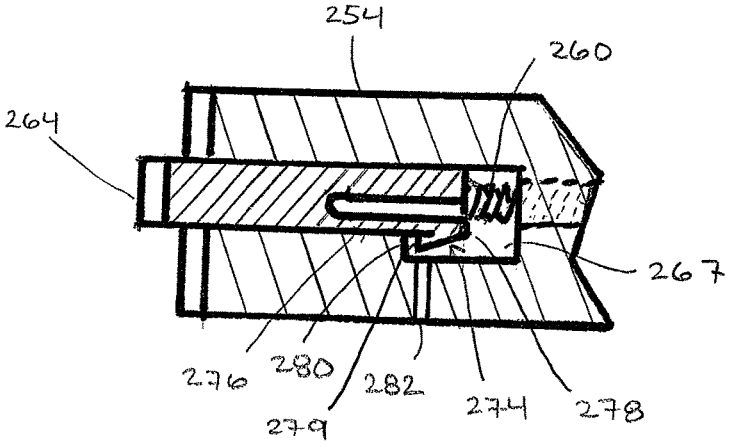
FIG. 35 is a cross-sectional view of a portion of the weight member of FIG. 33, as shown by line 35-35 illustrated in FIG. 34.

In another embodiment, illustrated in FIGS. 31 and 32 is a weight member 230 that may be substituted for weight member 202 in golf club head 200. Weight member 230 includes a spring body 232 and a body 234. In general, the spring body 232 is a generally tubular, cylindrical member that includes integrated spring features 236, and that is disposed on and attached to a first portion of body 234 having a first diameter that is smaller than a second portion having a second diameter. The spring body 232 may be attached to body 234 by mechanical, metallurgical or adhesive mechanisms. The construction provides the advantages of providing fewer parts and simplifying the assembly of the weight member.

Spring body 232 is constructed from a tubular member. Portions of the wall of the tubular member may be cut to include slots that define cantilevered arms. Each of the cantilevered arms includes a first end 238 that is fixed, and a second end 240 that is spaced from first end 238 by the length of the cantilevered arm. The cantilevered arms are bent at first end 238 to form them into spring features 236. In particular, the cantilevered arms are bent outward from the tubular body so that at least a portion extends away from body 234 to provide the outer spring surfaces of the weight member 230. An additional inward bend is created at a location in each cantilevered arm spaced from first end 238 to create radial portions 242 of the cantilevered arms that extend radially inward. An additional bend may be created adjacent second end 240 to provide a tool engagement feature 244, which may be a hooked end of the spring feature 236 at second end 240.

Spring body 232 may be constructed from metallic material, such as titanium, or a polymeric material, such as polycarbonate. The spring body 232 is installed on body 234 to form weight member 230. The two components may be temporarily coupled or permanently coupled. For example, spring body 232 may be slipped over a reduced diameter portion of body 234.

Another embodiment of a weight member that may be substituted for weight member 202 in golf club head 200 is illustrated in FIGS. 33-36. In particular, weight member 252 includes a body 254 and a pair of spring features 256. Similar to previous embodiments, the spring features 256 may be moved relative to body 254 to reduce an outer dimension of the weight member 252, thereby allowing the weight member 252 to be inserted into a weight mount included in the golf club head.

Figure 36:
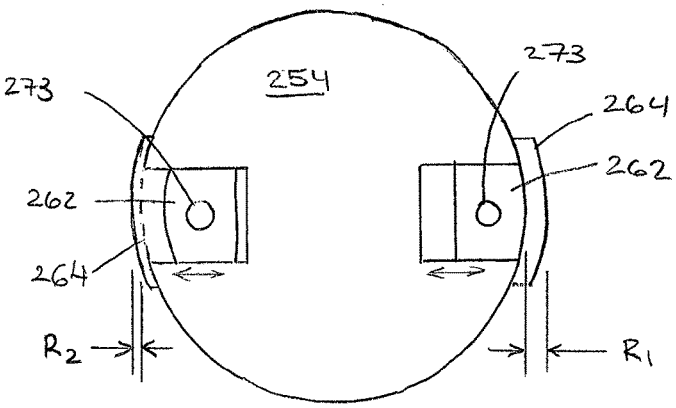
FIG. 36 is a top view of the weight member of FIG. 33.

In the present embodiment, the spring features 256 are formed as spring-loaded slides that are biased to extend radially outward from body 254. Similar to previous embodiments, the spring features are constructed so that at least a portion of each spring feature is movable between a first configuration and a second configuration and that change in configuration allows the weight member to be installed in a weight mount. In particular, a portion of the spring feature extends away from a side wall of body 254 by a first dimension $R_1$, and a second configuration in which a portion of the spring feature is movable to a position in which it extends away from a side wall of body 254 by a second dimension $R_2$ that is less than first dimension $R_1$. In the present embodiment, the tab portion 264 of the slide member 258 may be slid between the first configuration and the second configuration, as illustrated in FIG. 36. As described above, the opening in the weight mount is sized so that there is a gap between an outer dimension of the body 254 and the opening that has a gap dimension that is larger than second dimension $R_2$ however in this embodiment the weight member is preferably constructed to allow the tab portion of slide member 258 to be fully recessed into the side wall of the body 254 of the weight member. After the weight member 252 is inserted into the weight mount, through the opening, the spring features are allowed to move toward the first configuration into undercuts of the weight mount, such as under the influence of a spring member 260. Each undercut has a depth from the outer dimension of body 254 that is less than the first dimension $R_1$ of the first configuration of the spring features so that when the spring feature extends into the undercut it places a lateral force upon the sidewall of the weight mount 254 and retains weight member 252 in the weight mount.

Each spring feature 256 is constructed from a slide member 258 and the spring member 260 that applies a force on slide member 258 that forces the slide member radially outward with respect to body 254. Slide member 258 includes a body portion 262 and a tab portion 264. The body portion 262 is sized to slide within a slot 266 formed in body 254. The sides of body portion 262 and slot 266 may be configured to restrict relative movement between the slide member 258 and body 254 to a radial direction, such as by including a tongue and groove interface. For example, lateral grooves 268 may be included in the side walls of slot 266 that create a portion of slot 266 having a width that varies through the thickness of body 254. The sides of slide member 258 include tongues 270 that are sized to slide within grooves 268.

The body portion 262 of the slide member 258 includes a bore 272 that receives a portion of spring member 260 that extends from body 254 into slot 266. The spring member 260 is preferably partially compressed so that it forces slide member 258 to extend outward radially. It should be appreciated that the slide member 258 and body 254 may be configured to utilize a helical spring, as shown, or another spring configuration such as watch pin spring, a leaf spring, torsional spring or belville washers. A tool engagement feature 273 may be included on the body portion 262 of the slide member 258 that allows a user to activate the weight member by moving the slide members 258 relative to the body 254. For example, the tool engagement feature may be a recess included on a portion of slide member 258 that is exposed externally when weight member 252 is installed in a weight mount of a golf club head. In the illustrated embodiment, each of the slide members 258 includes a recess so that a tool, such as a spanner wrench having two projections that are translatable toward and away from each other, may be used to translate the slide members 258 toward each other against the influence of the spring members 260. Translating the slide members 258 toward each other reduces the outer dimension of the weight member 252 allowing it to be inserted and removed from a weight mount having an undercut construction, such as weight mount 204.

The translation motion of the slide member 258 relative to body 254 is limited in an inward direction by body 254 and in an outward direction by a slide stop 274. Slide stop 274 includes a cantilevered arm 276 and a locking tab 278. Cantilevered arm 276 is preferably formed as part of the body portion 262 of slide member 258 and is configured to be bendable. Locking tab 278 is constructed so that it includes a ramped surface that allows the slide member 258 to be inserted into slot 266 while causing the cantilevered arm to bend during insertion. When slide member 258 is fully installed, locking tab 278 is received in a locking recess 267 included in slot 266. Locking tab 278 also includes a locking shoulder 279 that opposes a shoulder 280 formed in a portion of slot 266 when slide member 258 is fully installed in body 254. The opposing shoulders restrict the relative movement of slide member 258 and body 254 so that slide member 258 can not be removed from body 254 without bending cantilevered arm 276 to allow locking tab to slide through slot 266. An access port 282 may be included in body 254 that exposes a portion of the slide stop through the body 254 to allow a tool to be inserted to contact a portion of slide stop 274 to bend cantilevered arm 276, thereby allowing slide member 258 to be removed from body.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf club head including a weight member, comprising:

a club head body having a hollow construction defined by a face defining a ball-striking surface, a sole, a crown, and a skirt, wherein the sole extends aftward from a lower edge of the face, wherein the crown extends aftward from an upper edge of the face, and wherein the skirt extends between the sole and the crown around a perimeter of the body;

a weight mount disposed on at least one of the sole, the crown, and the skirt, wherein the weight mount defines a perimeter wall, wherein a portion of the perimeter wall defines an undercut having an undercut depth $R_u$; and a weight member that includes a weight body defining a side wall, a bore, and a spring feature, wherein at least a portion of the spring feature is movably coupled to the weight body so that it is movable between a first configuration and a second configuration, wherein in the first configuration a portion of the spring feature extends outward from a side wall of the weight body by a first distance $R_1$, wherein in the second configuration a portion of the spring feature extends outward from a side wall of the weight body by a second distance $R_2$, wherein the spring feature is a cantilevered arm that includes a fixed end coupled to the weight body and a cantilevered end, wherein the bore of the weight body receives a portion of the cantilevered arm, wherein the undercut depth $R_u$ is less than the first distance $R_1$ and greater than the second distance $R_2$ so that the spring feature abuts the undercut of the perimeter wall of the weight mount, and wherein the spring feature is at least partially flexed by the abutment of the spring feature with the perimeter wall when the weight member is installed in the weight mount.

2. The golf club head of claim 1, wherein the first distance $R_1$ is between about 1.0 mm and about 4.0 mm, and wherein the second distance $R_2$ is less than 1.0 mm.

3. The golf club head of claim 1, wherein the weight body is cylindrical and the bore is a diametric bore that receives the portion of the cantilevered arm.

4. The golf club head of claim 3, wherein the cantilevered end of the cantilevered arm extends into the diametric bore of the weight body.

5. The golf club head of claim 3, wherein the cantilevered arm further comprises a radial arm that extends radially from a location on the cantilevered arm that is closer to the cantilevered end than the fixed end, and wherein the radial arm extends into the diametric bore.

6. The golf club head of claim 1, wherein the cantilevered arm is formed by a slot cut in the sidewall of a tubular member.

7. The golf club head of claim 6, wherein the weight body is a cylindrical member having a first portion having a first outer diameter and a second portion having a second outer diameter, wherein the first outer diameter is smaller than the second outer diameter, wherein the tubular member is coupled to the weight body on the first portion.

8. A golf club head including a weight member, comprising:

a club head body having a hollow construction defined by a face defining a ball-striking surface, a sole, a crown, and a skirt, wherein the sole extends aftward from a lower edge of the face, wherein the crown extends aftward from an upper edge of the face, and wherein the skirt extends between the sole and the crown around a perimeter of the body;

a weight mount disposed on at least one of the sole, the crown, and the skirt, wherein the weight mount defines a perimeter wall, wherein a portion of the perimeter wall defines an undercut having an undercut depth $R_u$; and a weight member that includes a weight body defining a side wall and a spring feature, wherein at least a portion of the spring feature is movably coupled to the weight body so that it is movable between a first configuration and a second configuration, wherein in the first configuration a portion of the spring feature extends outward from a side wall of the weight body by a first distance $R_1$, wherein in the second configuration a portion of the spring feature extends outward from a side wall of the weight body by a second distance $R_2$, wherein the undercut depth $R_u$ is less than the first distance $R_1$ and greater than the second distance $R_2$ so that the spring feature abuts the undercut of the perimeter wall of the weight mount, wherein the spring feature is a cantilevered arm, wherein the cantilevered arm includes a fixed end and a cantilevered end, and the fixed end is coupled to the weight body, wherein the weight body includes a diametric bore that receives a portion of the cantilevered arm and the weight body includes a slot that intersects the diametric bore so that at least a portion of the cantilevered arm is exposed when the weight member is installed in a weight mount, and wherein the spring feature is at least partially flexed by the abutment of the spring feature with the perimeter wall when the weight member is installed in the weight mount.

9. The golf club head of claim 8, wherein the cantilevered arm is constructed as a separate component and mechanically coupled to the weight body.

10. The golf club head of claim 8, wherein the cantilevered arm is formed by a slot cut in the sidewall of a tubular member.

11. The golf club head of claim 10, wherein the weight body is a cylindrical member having a first portion having a first outer diameter and a second portion having a second outer diameter, wherein the first outer diameter is smaller than the second outer diameter, wherein the tubular member is coupled to the weight body on the first portion.

12. The golf club head of claim 8, wherein the first distance $R_1$ is between about 1.0 mm and about 4.0 mm, and wherein the second distance $R_2$ is less than 1.0 mm.

13. A golf club head including a weight member, comprising:

a club head body having a hollow construction defined by a face defining a ball-striking surface, a sole, a crown, and a skirt, wherein the sole extends aftward from a lower edge of the face, wherein the crown extends aftward from an upper edge of the face, and wherein the skirt extends between the sole and the crown around a perimeter of the body;

a weight mount disposed on at least one of the sole, the crown, and the skirt, wherein the weight mount defines a perimeter wall, wherein a portion of the perimeter wall defines an undercut having an undercut depth $R_u$; and a weight member that includes a weight body defining a side wall and a spring feature, wherein at least a portion the spring feature is movably coupled to the weight body so that it is movable between a first configuration and a second configuration, wherein in the first configuration a portion of the spring feature extends outward from a side wall of the weight body by a first distance $R_1$, wherein in the second configuration a portion of the spring feature extends outward from a side wall of the weight body by a second distance $R_2$, wherein the undercut depth $R_u$ is less than the first distance $R_1$ and greater than the second distance $R_2$ so that the spring feature abuts the undercut of the perimeter wall of the weight mount when the weight member is installed in the weight mount, wherein the spring feature is a slide member that slides in the weight body between the first configuration and the second configuration, wherein the weight body includes a radial slot and side walls of the radial slot include grooves, wherein the slide member is disposed in the slot and portions of the slide member extend into the grooves, wherein in the second configuration an outer edge of the slide member is closer to flush with the weight body than the first configuration, and wherein the spring feature is at least partially flexed by the abutment of the spring feature with the perimeter wall when the weight member is installed in the weight mount.

14. The golf club head of claim 13, wherein weight member comprises a slide stop, the slide stop comprising a cantilevered arm and a locking tab disposed in a recess formed in the radial slot.

15. The golf club head of claim 14, wherein the weight body includes an access port that extends into the slot and that exposes a portion of the slide stop through the weight body.

16. The golf club head of claim 13, wherein the slide member includes a tool engagement feature that is formed by a recess on a surface of the slide member that is exposed externally when the weight member is installed in the weight mount on the golf club head.

* * * * *